United States Patent [19]

Burson

[11] 4,288,834

[45] Sep. 8, 1981

[54] BREAKERLESS MAGNETO IGNITION

[75] Inventor: Bob O. Burson, East Longmeadow, Mass.

[73] Assignee: R. E. Phelon Company, Inc., East Longmeadow, Mass.

[21] Appl. No.: 28,724

[22] Filed: Apr. 9, 1979

[51] Int. Cl.[3] ..... F02P 3/06

[52] U.S. Cl. ..... 361/256; 123/601; 315/209 SC

[58] Field of Search ..... 361/256, 258, 263; 123/148 E; 315/209 SC; 307/252 C

[56] References Cited

U.S. PATENT DOCUMENTS

| | | | |
|---|---|---|---|
| 3,280,810 | 10/1966 | Worrell et al. | 307/252 C |
| 3,297,911 | 1/1967 | Quinn | 307/252 C |
| 3,308,800 | 3/1967 | Motto, Jr. et al. | 307/252 C |
| 3,405,347 | 10/1968 | Swift et al. | 315/209 SC |
| 4,016,433 | 4/1977 | Brooks | 315/209 SC |
| 4,109,632 | 8/1978 | Brooks | 315/209 SC |

*Primary Examiner*—C. C. Shaw

*Attorney, Agent, or Firm*—Chapin, Neal & Dempsey

[57] ABSTRACT

A breakerless magneto ignition system having a stator assembly including an ignition coil and core. A solid state gate turn-off switch (GTO) is connected by its anode-cathode electrodes in circuit with the primary winding of the ignition coil for conducting primary current. A solid state switching component is connected in circuit with the control electrode or gate of the GTO and with a capacitor which is charged by current generated in the primary winding in one direction as a result of magneto rotation. The stator assembly includes a trigger coil circumferentially spaced from a leg of the core of the ignition coil a distance approximately equal to the edge distance of the magneto to provide a trigger pulse. The trigger pulse is applied to a control electrode of the solid state switching device for switching the device to its conductive state whereby the charge on said capacitor provides a voltage polarity which causes the main current flow in the GTO to be shunted by its gate electrode from its anode-cathode path, thereby opening the primary circuit to cause an ignition pulse to be induced in the secondary winding of the ignition coil.

4 Claims, 5 Drawing Figures

BREAKERLESS MAGNETO IGNITION

BACKGROUND

Breakerless ignition systems have been available for a number of years in which various solid state electronic components are used in place of mechanical breaker points. One such system, for example, is shown in Swift U.S. Pat. No. 3,405,347 wherein a gate controlled switch (GCS) is utilized to make and break the circuit of the primary winding of an ignition coil. This breakerless ignition system involves in one embodiment a silicon controlled rectifier and a plurality of separate triggering coils for controlling the "on" and "off" operation of the GCS which, at the present time, are of somewhat limited availability and thus relatively costly. Moreover, such devices are highly sensitive in operation and require quite delicate and critical control of the currents of the pulses used for turning the device "off" and "on". For example, such control currents run in the milliampere range.

The principal object of this invention is to provide a breakerless ignition system which is highly reliable in operation and relatively simple and economical to manufacture.

Another object of this invention is to provide a breakerless ignition system of the above type in which current generated in the primary winding of the ignition coil is utilized both for turning "on" and "off" a solid state electronic ignition switching device for making and breaking the primary circuit of the ignition coil, thereby eliminating the necessity of a number of separate control coils.

A further object of this invention is to provide a breakerless ignition system of the above type in which a single trigger coil is fabricated directly into the stator assembly to provide a trigger signal which results in breaking the primary circuit of the ignition coil.

Yet another object of this invention is to provide a breakerless ignition system which utilizes a gate-turn-off silicon controlled rectifier and a solid state electronic switching device which makes and breaks the primary winding of the ignition coil utilizing power derived from the primary winding of the engine coil.

The above and other objects of this invention will be more readily apparent from the following description in reference to the accompanying drawings, in which.

Figure 1:
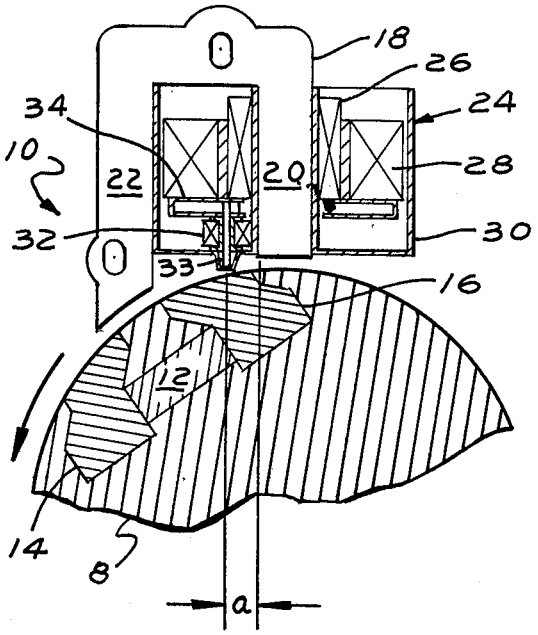
FIG. 1 is a partial elevational view illustrative of a breakerless magneto embodying this invention.

Referring in detail to the drawings, in FIG. 1 is shown a portion of a magneto comprising rotor 8 and a stator 10. As shown, the flywheel rotor may be a die cast containing within its periphery or rim portion a permanent magnet 12 and a pair of pole shoe pieces 14 and 16 clamped against the opposite end poles of the permanent magnet.

Figure 3:
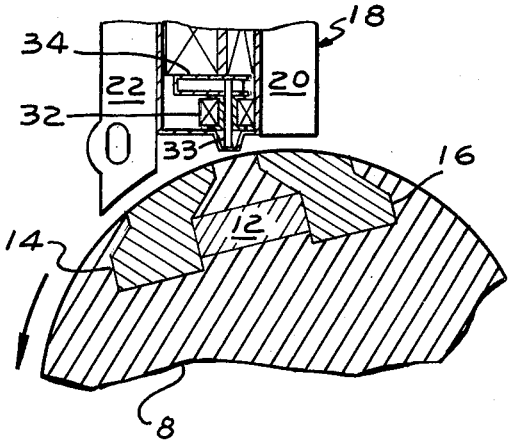

The stator 10 includes a generally U-shaped core or armature 18 having its leg portions 20 and 22 terminating adjacent the path of rotation of the rotor whereby upon rotation of the rotor 8 a strong magnetic flux is generated through the core 18. An ignition coil 24 is mounted on one leg portion 20 of the core 18 and includes a primary coil 26 and a secondary coil 28 disposed within a housing or shell 30. A small trigger coil 32 wound on a ferromagnetic core 33 is disposed within the housing 30 adjacent core leg 20 and spaced therefrom a distance a. The gap a is approximately equal to the edge distance of the magneto which at the time of maximum current generation in the primary coil is defined as the distance measured from the trailing edge of the leading pole shoe 14 to the inner or trailing edge of the core leg 20. Also disposed within the shell 30 is an electronic module or circuit board 34 for which FIG. 3 is a the circuit diagram.

Figure 5:
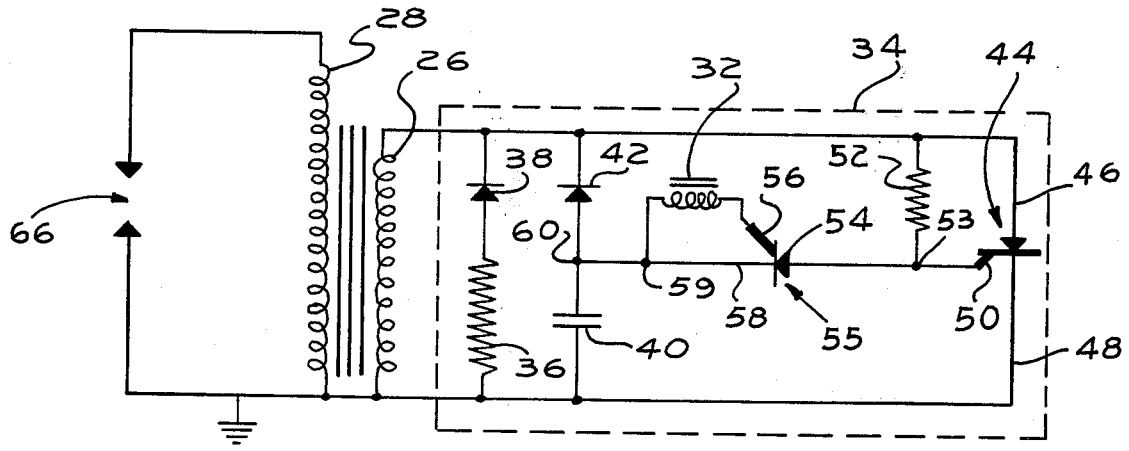
FIG. 5 is a schematic wiring diagram illustrating the electronic components and their operation of the magneto embodying this invention.

A suitable synthetic plastic material disposed within the coil housing 30 encapsulates the ignition coil, trigger coil and circuit module except for the outer tips of leg 20 and core 33. The electronic and electrical components shown in FIG. 5 serve as a breakerless electronic ignition system for making and breaking the circuit of the primary winding 26. The circuit comprises a resistor 36 in series with a diode 38 electrically connected across the terminal ends of the primary winding 26, and which serve to limit the voltage stored on capacitor 40 which is similarly connected in series with a diode 42 across the primary coil 26. Resistor 36 also serves to protect solid state switching device 44 connected to opposite ends of the primary winding 26, as will hereinafter be described.

In accordance with this invention, the solid state switching device 44 constitutes a gate-turn off silicon controlled rectifier known as GTO, which has an anode 46 and cathode 48 connected in series with primary winding 26. A gate electrode 50 controls the operation of the GTO. As discussed in U.S. Pat. No. 4,016,433, a GTO is a solid state switching device having its main current path from the anode to cathode electrode. The gate electrode 50 receives control pulses for turning the GTO "on" and "off". A suitable positive voltage applied to the gate 50 of the GTO will initiate current flow from the gate electrode to the cathode 48, thereby turning the GTO "on". The GTO may be turned "off" by shunting current away from the anode-cathode junction of the device. For example, heavy current flow from the anode 46 through the gate electrode 50 for a sufficient period of time will turn the device "off". A biasing resistor 52 is connected at one end to the anode and at its other end to the gate electrode of the GTO for turning the device "on".

The gate and resistor of GTO 44 have a common junction 53 which is connected to the anode 54 of a solid state switching device, such as a transistor or SCR 55. The control electrode 56 of the SCR is connected to one end terminal of trigger coil 32, the other end of the trigger coil being connected at 59 to conductor 58, which connects to junction 60 between the diode 42 and the capacitor 40, which is thus in circuit with the cathode of the SCR 54.

Figure 2:
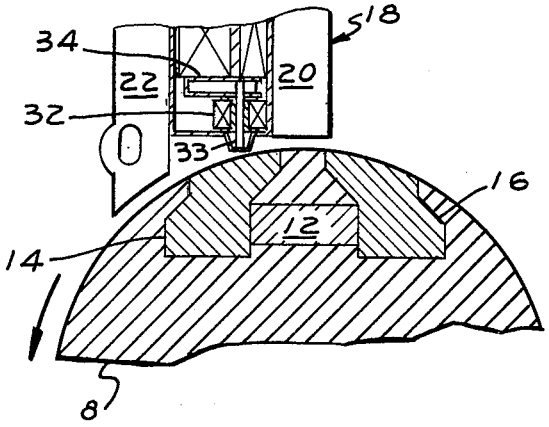
FIGS. 2 and 3 are views similar to FIG. 1 but with the parts thereof in different operative relationship.
Figure 4:
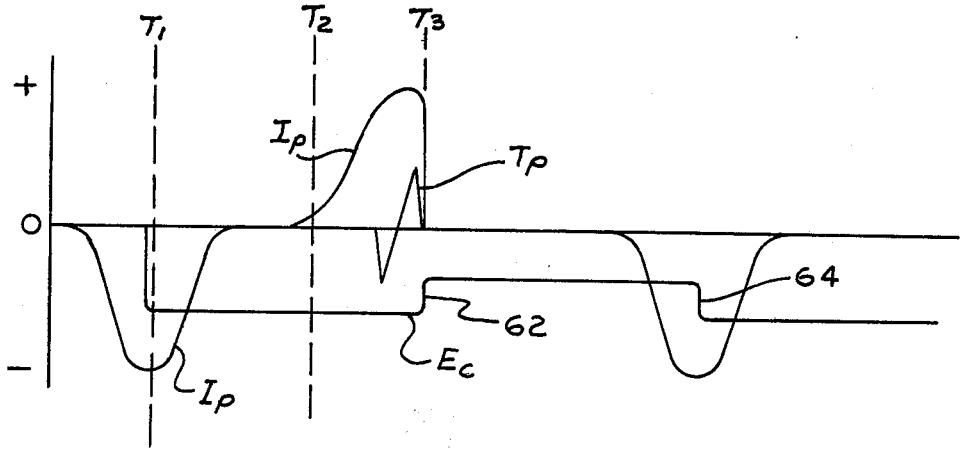
FIG. 4 is graphic representations of the electrical generations resulting in sequential relation during operation of the breakerless magneto embodying this invention.

When the pole shoes 14 and 16 of the rotor 8 are rotated past the legs 20 and 22 of the core 18, as shown in FIG. 1, current of one polarity Ip (FIG. 4) is generated at time T1 in the primary coil 26 which charges capacitor 40 to a predetermined potential which, for purposes of this description, may be considered a negative potential, as shown at Ec in FIG. 4. At this stage of the operating cycle, GTO 44 is in a non-conductive state as is SCR 54. Thus, when the capacitor 40 is charged, it will retain this charge, since blocking diode 42 prevents loss of the charge upon reversal of the polarity of the voltage of the primary coil. On the next revolution of rotor 8, as shown in FIG. 2, the voltage induced in the primary coil 26 and thus the primary current Ip changes from a negative to a positive polarity, as indicated at time T2 in FIG. 4, and the gate 50 of the GTO will be biased positive. The gate-cathode current will cause the GTO to turn "on", whereby the anode-cathode electrodes are switched to their low impedance state and the large primary winding current Ip is provided with a low impedance path through the anode-cathode junction of the GTO. As previously indicated, the GTO will continue conducting in this manner until the primary current Ip reaches a maximum value as at T3 in FIG. 4 at which time the GTO will be switched "off".

In accordance with this invention, the switching of the GTO to its "off" state is accomplished by the negative charge Ec stored on the capacitor 40 being applied to the gate electrode 50 of the GTO. This occurs when a trigger signal Tp (FIG. 4) is generated in trigger coil 32. As shown in FIG. 3, this pulse is generated when the core 33 is approximately centered in the gap between the inner edges of pole shoes 14 and 16. The trigger pulse Tp thus generated is applied to the control electrode 56 of the SCR 55, which is thereby rendered conductive so that the positive anode-cathode current Ip flowing in the GTO sees the negative charge on capacitor 40 and is diverted or shunted away from the cathode through the anode-gate path of SCR 55. In other words, in the embodiment illustrated, the gate of the GTO sees a relatively large negative potential Ec and as a result about 70%–80% of the anode-cathode current flowing through the GTO is diverted to the gate 50, causing a drop of about 10% in the negative charge on the capacitor, as illustrated at 62 in FIG. 4. As a result of this collapse of the primary current Ip flowing in winding 26, a large reverse voltage is induced in the secondary winding 28 to provide an ignition pulse across the contacts of a spark plug 68. The capacitor is recharged as at 64 to its full potential as the pole shoes rotate past leg 22 of the core 18, as illustrated in FIG. 1.

This shunting of current by the gate 50 of the GTO is of sufficient time duration to cause the GTO to be switched "off" and it will remain in this non-conductive mode until again turned "on". During each revolution of the magneto rotor a negative going primary current Ip at time T1 will recharge the capacitor to its prefiring level and the next positive going primary current starting at time T2 will turn "on" the GTO preparatory to generation of the next trigger pulse at T3. It will thus be seen that the power generated in the primary winding 26 of the ignition coil is used both to turn "off" and "on" the GTO, the turn "on" being accomplished by primary current flow through the biasing resistor 52 and the turn "off" being accomplished by current generated in the primary coil 26 which charges capacitor 40. The small pulse generated in trigger coil 32 is simply used to cause any reliable, low cost solid state switching device such as SCR 54 to become conductive for shunting the large primary current from the anode-cathode path of GTO, as previously described.

Having thus described the invention, what is claimed is:

1. Breakerless magneto ignition system including a magnetic pole carrying rotor and a stator having a ferromagnetic core with primary and secondary ignition coil windings disposed on said core, said ignition system comprising a trigger coil circumferentially spaced from a leg of said core in the direction of rotation of said rotor a distance approximately equal to the edge distance of the magneto, a gate turn-off silicon controlled rectifier having anode, cathode and gate electrodes, a capacitor connected in circuit with said primary winding to be charged by electrical pulses of one polarity generated in said primary winding, circuit means connecting the gate of said rectifier with said capacitor, said circuit means including a solid state electronic switching device having cathode and anode electrodes in series with said capacitor and the gate of said rectifier, said device also including a control electrode electrically connected with said trigger coil for receiving pulses of electrical energy generated in response to rotation of said magneto for switching said device to its conductive mode through its anode-cathode electrodes whereby said charge of electrical energy of one polarity stored on said capacitor is applied to the gate electrode of said gate turn-off rectifier for shunting the primary current flowing in the anode-cathode path of said rectifier through the gate electrode toward the charged capacitor causing said rectifier to be turned off, thereby opening the circuit of the primary winding to induce an ignition voltage pulse in said secondary winding.

2. Breakerless magneto ignition system as set forth in claim 1 in which the anode-cathode electrodes of said gate turn-off rectifier are in circuit with the primary winding to provide a low impedance path with a current generated therein by the rotation of said magneto, said capacitor being connected in series with a unidirectional conductive device across said primary winding and impedance means connected from one end of said primary winding to the gate of said rectifier for biasing the same to its low impedance condition as a result of primary current flowing through said impedance means.

3. Breakerless magneto ignition system as set forth in claim 2 in which said switching device comprises a silicon controlled rectifier having its anode-cathode electrodes connected in series between the gate of said turn-off rectifier and the charge of one polarity stored on said capacitor, the electrode of said silicon controlled rectifier being electrically connected to said trigger coil.

4. Breakerless magneto ignition system as set forth in claim 3 in which said ferromagnetic core is of generally U-shaped configuration having the outer ends of its legs disposed adjacent the path of rotation of said rotor, said ignition coil being disposed on one leg of said core and said trigger coil including a core being spaced from said one leg, said system including a module containing the electrical components of said system being disposed within a body of dielectric material encapsulating said ignition coil, trigger coil and module.

* * * * *